US008173960B2

(12) United States Patent
Tang et al.

(10) Patent No.: US 8,173,960 B2
(45) Date of Patent: May 8, 2012

(54) LOW PRESSURE ELECTROSPRAY IONIZATION SYSTEM AND PROCESS FOR EFFECTIVE TRANSMISSION OF IONS

(75) Inventors: Keqi Tang, Richland, WA (US); Jason S Page, Kennewick, WA (US); Ryan T Kelly, West Richland, WA (US); Richard D Smith, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 265 days.

(21) Appl. No.: 12/468,645

(22) Filed: May 19, 2009

(65) Prior Publication Data

US 2009/0242755 A1 Oct. 1, 2009

Related U.S. Application Data

(63) Continuation-in-part of application No. 11/848,884, filed on Aug. 31, 2007, now Pat. No. 7,671,344.

(51) Int. Cl.
*H01J 49/26* (2006.01)

(52) U.S. Cl. ..... 250/288; 250/281; 250/282; 250/283

(58) Field of Classification Search ..... 250/281, 250/282, 283, 288
See application file for complete search history.

(56) References Cited

U.S. PATENT DOCUMENTS

| | | | | |
|---|---|---|---|---|
| 4,531,056 | A * | 7/1985 | Labowsky et al. | 250/288 |
| 4,607,163 | A | 8/1986 | Mizuno | |
| 5,115,131 | A | 5/1992 | Jorgenson et al. | |
| 5,838,002 | A | 11/1998 | Sheehan | |
| 6,107,628 | A | 8/2000 | Smith et al. | |
| 6,124,592 | A | 9/2000 | Spangler | |
| 6,147,345 | A * | 11/2000 | Willoughby | 250/288 |
| 6,278,111 | B1 | 8/2001 | Sheehan et al. | |
| 6,455,846 | B1 * | 9/2002 | Prior et al. | 250/288 |
| 6,784,424 | B1 | 8/2004 | Willoughby et al. | |
| 7,064,321 | B2 | 6/2006 | Franzen | |
| 7,312,444 | B1 | 12/2007 | Willoughby et al. | |
| 2006/0108520 | A1 * | 5/2006 | Park et al. | 250/287 |
| 2006/0186329 | A1 | 8/2006 | Gebhardt et al. | |

(Continued)

FOREIGN PATENT DOCUMENTS

EP 2007079588 A1 7/2007

(Continued)

OTHER PUBLICATIONS

R. T. Kelly, J. S. Page, K. Tang, and R. D. Smith, Array of Chemically Etched Fused Silica Emitters for Improving the Sensitivity and Quantitation of Electrospray Ionization Mass Spectrometry, Anal. Chem., Jun. 1, 2007, 4193-4198 pps., vol. 79, No. 11.

(Continued)

*Primary Examiner* — David A Vanore
*Assistant Examiner* — Nicole Ippolito
(74) *Attorney, Agent, or Firm* — Allan C. Tuan

(57) ABSTRACT

Systems and methods that provide up to complete transmission of ions between coupled stages with low effective ion losses. An "interfaceless" electrospray ionization system is further described that operates an electrospray at a reduced pressure such that standard electrospray sample solutions can be directly sprayed into an electrodynamic ion funnel which provides ion focusing and transmission of ions into a mass analyzer. Furthermore, chambers maintained at different pressures can allow for more optimal operating conditions for an electrospray emitter and an ion guide.

16 Claims, 9 Drawing Sheets

U.S. PATENT DOCUMENTS

| | | | | |
|---|---|---|---|---|
| 2006/0192108 | A1* | 8/2006 | Yeatman et al. | 250/288 |
| 2006/0219889 | A1* | 10/2006 | Shvartsburg et al. | 250/282 |
| 2007/0114382 | A1 | 5/2007 | Clemmer et al. | |
| 2007/0181801 | A1* | 8/2007 | Yamada et al. | 250/288 |

FOREIGN PATENT DOCUMENTS

| | | | |
|---|---|---|---|
| GB | 2429836 | A | 3/2007 |
| WO | 9534089 | | 12/1995 |
| WO | 9807505 | | 2/1998 |

OTHER PUBLICATIONS

K. Tang, Y. Lin, D. W. Matson, T Kim, and R. D. Smith, Generation of Multiple Electrosprays using Micro-fabricated Emitter Arrays for Improved Mass Spectrometric Sensitivity, Anal. Chem., vol. 73, No. 8, Apr. 15, 2001, 1658-1663 pps.

J. S. Page, R. T. Kelly, K. Tang and R. D. Smith, Ionization and transmission efficiency in an electrospray ionization mass spectrometry interface, J. Am Soc Mass Spectrom, Jun. 2, 2007, 1582-1590 pps.

Y. Ibrahim, K. Tang, A. V. Tolmachev, A. A. Shvartsburg and R. D. Smith, Improving the Sensitivity of Mass Spectrometer using a High-Pressure Electrodynamic Ion Funnel Interface, J. Am Soc Mass Spectrom., Jun. 9, 2006,vol. 17, 1299-1305 pps.

Cook, K. D., Electrohydrodynamic Mass Spectrometry. Mass Spectrometry Reviews, 1986, 5, 467-519 pps., John Wiley & Sons, Inc.

Gamero-Castano, M.; Aguirre-De-Carcer, I.; De Juan, L.; Fernandez de la Mora, J., On the Current Emitted by Taylor Cone-Jets of Electrolytes in Vacuo—Implications for Liquid Metal Ion Sources, 1998, American Institute of Physics, vol. 83, 2428-2434 pps.

Romero-Sanz, I.; De La Mora, J. F., Energy Distribution and Spatial Structure of Electrosprays of Ionic Liquids in Vacuo, Feb. 15, 2004, J. Appl. Phys, vol. 95, 2123-2129 pps.

Hendricks, C. D., Charged Droplet Experiments, J. Colloid Interface Sci., 1962, vol. 17, 249-259 pps.

Aguirre-De-Carcer, I.; Fernandez De La Mora, J., Effect of Background Gas on the Current Emitted from Taylor Cones. J. Colloid Interface Sci., 1995, vol. 171, 512-517 pps.

Sheehan, EW; Willoughby, RC; Novel Electrospray Source Design, Chem-Space Associates, Pittsburgh, PA, 1095 pp.

Page, Jason S., et al., "Ionization and Transmission Efficiency in an Electrospray Ionization—Mass Spectrometry Interface," J Am, Soc. Mass Spectrom, 2007, vol. 18, 1582-1590 pages, USA.

International Search Report/Written Opinion, 2008.

Shaffer, Scott, et al, A Novel Ion Funnel for Focusing Ions at Elevated Pressure Using Electrospray Ionization Mass Spectrometry, Rapid Communications in Mass Spectrometry, Heyden, London, GB, vol. 11, Jan. 1, 1997.

* cited by examiner

LOW PRESSURE ELECTROSPRAY IONIZATION SYSTEM AND PROCESS FOR EFFECTIVE TRANSMISSION OF IONS

STATEMENT REGARDING FEDERALLY SPONSORED RESEARCH OR DEVELOPMENT

This invention was made with Government support under Contract DE-AC05-76RLO1830 awarded by the U.S. Department of Energy. The Government has certain rights in the invention.

PRIORITY

This invention claims priority from, and is a continuation-in-part of, currently pending patent application publication no. 2009-0057551, filed Aug. 31, 2007, the content of which is incorporated herein by reference.

FIELD OF THE INVENTION

The present invention relates generally to analytical instrumentation and more particularly to a low pressure electrospray ionization system and process for effective transmission of ions between coupled ion stages with low ion losses.

BACKGROUND OF THE INVENTION

Achieving high sensitivity in mass spectrometry (MS) is key to effective analysis of complex chemical and biological samples. Every significant improvement in MS detection limits will enable applications that were previously impractical. Advances in MS sensitivity can also increase the dynamic range over which quantitative measurements can be performed.

FIG. 1 illustrates an electrospray ionization/mass spectrometer (ESI/MS) instrument configuration of a conventional design. In the figure, an atmospheric pressure electrospray ionization (ESI) source with an ES emitter couples to an ion funnel positioned in a low pressure (e.g., 18 Torr) region via a heated inlet capillary interface. Ions formed from electrospray at atmospheric pressure are introduced into the low pressure region through the capillary inlet and focused by the first ion funnel. A second ion funnel operating at a lower pressure (e.g., 2 Torr) than the first ion funnel operating pressure provides further focusing of ions prior to their introduction into a mass analyzer.

It well known in the art that sensitivity losses in ESI/MS are pronounced at the interface between the atmospheric pressure region and the low pressure region. Ion transmission through conventional interfaces is essentially limited by small MS sampling inlets—typically between 400 μm to 600 μm in diameter—required to maintain a good vacuum pressure in the MS analyzer. Sampling inlets can account for up to 99% of ion losses in the interface region, providing less than about 1% overall ion transmission efficiency. Accordingly, new systems, devices, and methods are needed to effectively eliminate the major ion losses in interface regions, e.g., between atmospheric ion source stage and a subsequent low pressure stage important to sensitive ion analyses.

SUMMARY OF THE INVENTION

The present invention is an electrospray ionization source that is characterized by a first vacuum chamber enclosing both an ESI transmitter and a feed line for a supply gas. The first vacuum chamber has an exit orifice positioned at an entrance to a first ion guide that is enclosed in a second vacuum chamber. A sample comprising electrospray ions is transmitted from the ESI transmitter to the ion guide through the exit orifice. Embodiments of the present invention provide improved ion transmission because the ESI transmitter and the ion guide are each operated at more optimal pressures without the extreme loss of ions typically associated with traditional capillary inlets.

In a preferred embodiment, the pressure in the first vacuum chamber is at least two times greater than that of the second vacuum chamber. For example, the pressure in the first chamber can be at least 50 Torr and the pressure in the second chamber can be at most 30 Torr.

According to one implementation a pump can be used to maintain a vacuum in the first and second vacuum chambers, wherein a pressure differential can be established between the two vacuum chambers by a flow of supply gas in the first chamber and by the exit orifice, which has a limited conductance. In some embodiments, the orifice can have a diameter between approximately 2 mm and 5 mm.

ESI source is consistent with the embodiments described and claimed herein can transmit at least 50% of the electrospray current from the ESI transmitter to the ion guide. This is a significant improvement over traditional ESI sources.

Preferred embodiments employ a chamber heating element that provides control of the temperature in the first vacuum chamber, which can improve desolvation.

The ESI transmitter can comprise a single emitter or a plurality of emitters. Specific examples of the ion guide can include, but are not limited to, an electrodynamic ion funnel or a multi-pole ion guide having a receiving aperture and a relatively smaller exit aperture. The multi-pole ion guide can comprise 2 n poles, where n is an integer greater than or equal to 2. Alternatively, the multi-pole ion guide can be a segmented multi-pole ion guide. The flow rate of the supply gas can be regulated by a controller operably attached to this feed line. In a preferred embodiment, the supply gas comprises an electron scavenger that can reduce the electrical breakdown in the first vacuum chamber. Exemplary electron scavenger's can include, but are not limited to $CO_2$ and $SF_6$.

The purpose of the foregoing abstract is to enable the United States Patent and Trademark Office and the public generally, especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Various advantages and novel features of the present invention are described herein and will become further readily apparent to those skilled in this art from the following detailed description. In the preceding and following descriptions, the various embodiments, including the preferred embodiments, have been shown and described. Included herein is a description of the best mode contemplated for carrying out the invention. As will be realized, the invention is capable of modification in various respects without departing from the invention. Accordingly, the drawings and description of the preferred embodiments set forth hereafter are to be regarded as illustrative in nature, and not as restrictive.

DETAILED DESCRIPTION OF THE PREFERRED EMBODIMENT OF THE INVENTION

While the present disclosure is exemplified by a description of the preferred embodiments, it should be understood that the invention is not limited thereto, and variations in form and detail may be made without departing from the scope of the invention. All modifications as would be envisioned by those of skill in the art in view of the disclosure are within the scope of the invention.

Figure 2A:
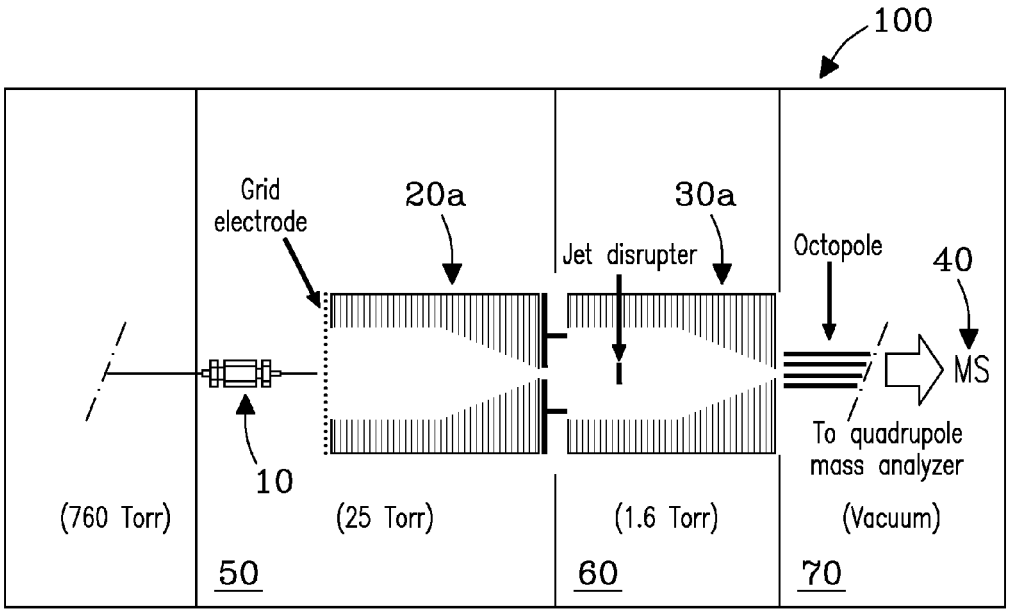
FIGS. 2*a*-2*d* illustrate various embodiments of the present invention.

FIG. 2*a* illustrates an instrument system 100 of the invention incorporating a preferred embodiment of an ESI source emitter 10. ES emitter (transmitter) 10 is shown positioned in a direct relationship with a first ion guide 20*a*, in this case an electrodynamic ion funnel 20*a*, via a receiving (entrance) aperture, in this case the first electrode of the electrodynamic ion funnel. ES emitter 10 was placed inside a first vacuum region 50 and positioned at the entrance of the first electrodynamic ion funnel, allowing the entire ES plume to be sampled by (i.e., transmitted directly to or within) the ion funnel. A second ion funnel 30*a* is shown within a second reduced pressure region or environment 60 to effect ion focusing prior to introduction to the vacuum region 70 of a mass selective analyzer 40. The second ion funnel is coupled to the first ion funnel. In the instant configuration, mass spectrometer 40 is preferably a single quadrupole mass spectrometer, but is not limited thereto. First ion funnel 20*a* had a lower capacitance than second ion funnel 30*a*, as described, e.g., by Ibrahim et al. (in *J. Am. Soc. Mass Spectrom.* 2006, 17, 1299-1305, incorporated herein in its entirety), but is not limited thereto. The low capacitance ion funnel permits use of higher frequency and amplitude RF voltage to effect capture and transmission of the ES ion plume for desolvation of the analyte ions at higher relative pressure compared to pressure in second ion funnel chamber 60. Transmission of ions in the ion plume from emitter 10 to first ion funnel 20*a*, to second ion funnel 30*a*, and ultimately to vacuum 70 of mass analyzer 40 occurs with low ion losses. In particular, transmission of ions in the ion plume proceeds at efficiencies or quantities up to 100%. And, results from test experiments demonstrated ion losses were significantly reduced compared to a conventional atmospheric pressure ESI source and heated capillary interface. Experiments further demonstrated that stable electrosprays were achieved at pressures down to at least about 25 Torr in pressure region 50.

Pressures described in conjunction with the instant embodiment are not to be considered limiting. In particular, pressures may be selected below atmospheric pressure. More particularly, pressures may be selected in the range from about 100 Torr to about 1 Torr. Most particularly, pressures may be selected below about 30 Torr. Thus, no limitations are intended.

While the instant embodiment has been described with reference to a single ES emitter, the invention is not limited thereto. For example, the emitter can be a multiemitter, e.g., as an array of emitters. Thus, no limitations are intended.

Figure 2B:
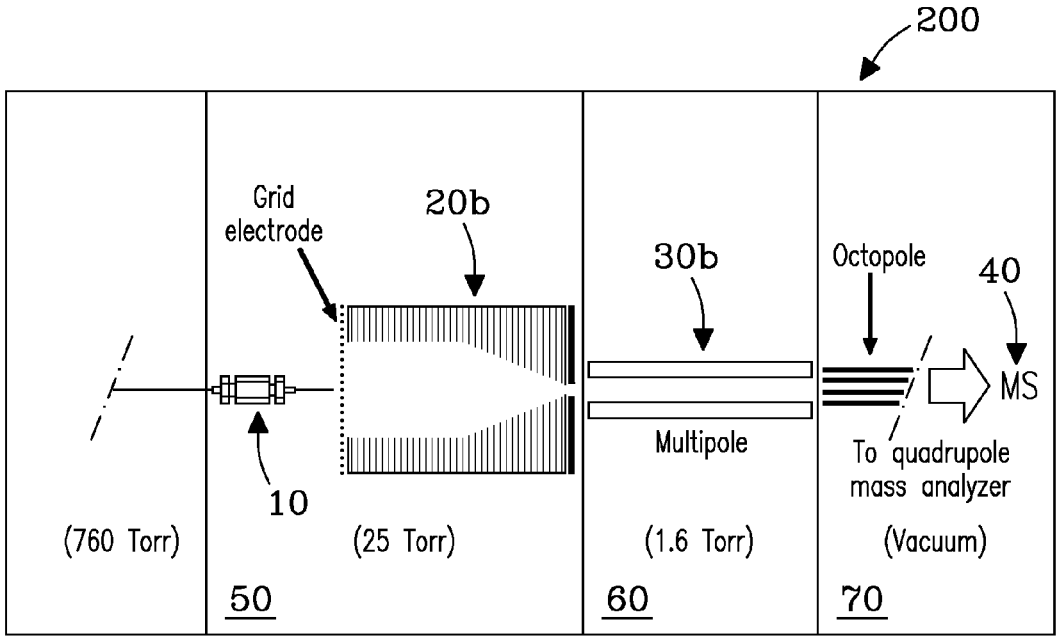

FIG. 2*b* illustrates an instrument system 200, according to another embodiment of the invention. In the instant configuration, the second ion funnel (FIG. 2*a*) is replaced by (exchanged with) an RF multipole ion guide 30*b*. Here, other illustrated components (emitter 10 and first ion funnel 20*b*) and pressures (e.g. in regions 50, 60, and 70) are identical to those previously described in reference to FIG. 2*a*, but should not be considered limiting. Multipole ion guide 30*b* can include (2·n) poles to effectively focus and transmit ions into MS 40, where n is an integer greater than or equal to 2. No limitations are intended.

Figure 2C:
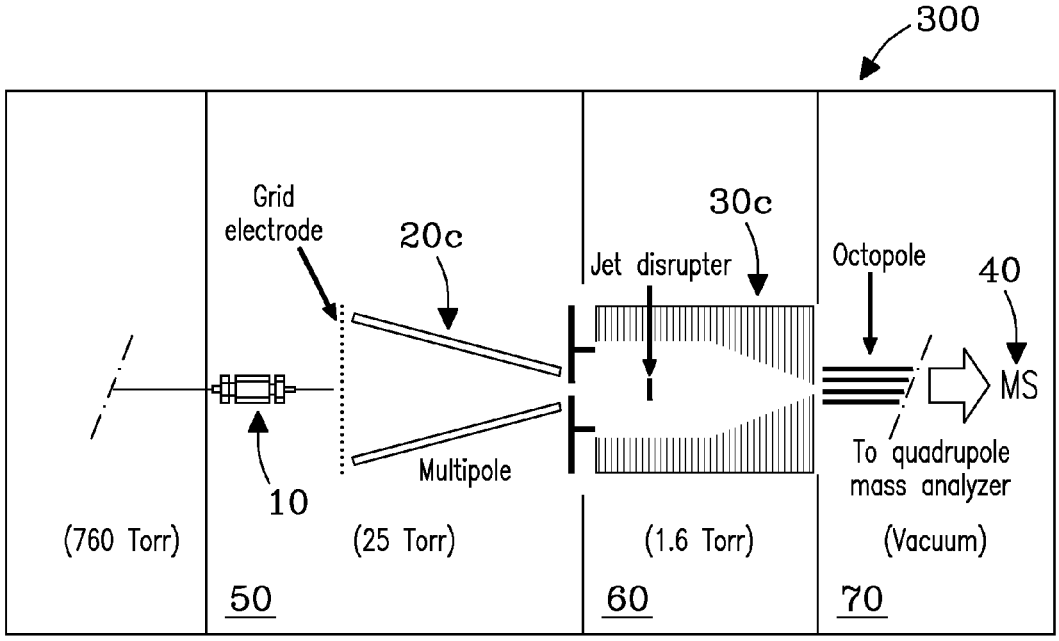

FIG. 2*c* illustrates an instrument system 300, according to yet another embodiment of the invention. In system 300, the first ion funnel (FIG. 2*a*) is replaced by an RF multipole ion guide 20*c*, which can include (2·n) poles to effectively focus and transmit ions into second ion funnel 30*c*, where n is any integer greater than 1. To effectively capture the ES plume, each pole in the multipole ion guide 20*c* can be tilted with a uniform or non uniform angle to create a larger entrance aperture facing the ES plume, and a smaller exit aperture into the second ion funnel. No limitations are intended. Other illustrated components (emitter 10 and MS 40) and pressures (e.g. in regions 50, 60, and 70) are identical to those previously described in reference to FIG. 2*a*, but should not be considered limiting.

Figure 2D:
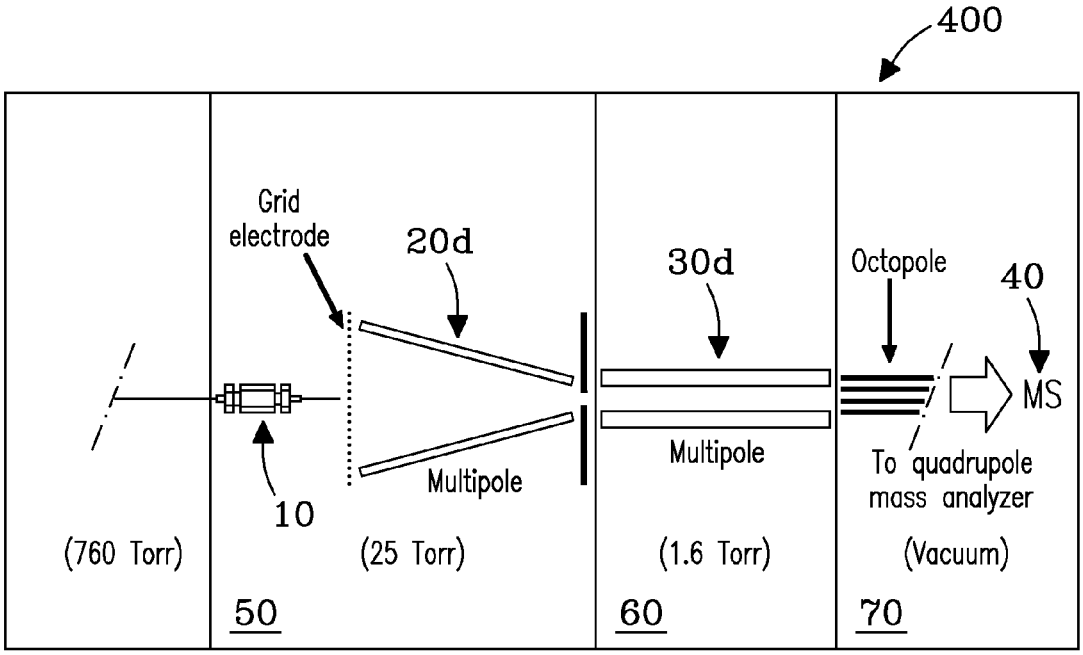

FIG. 2*d* illustrates an instrument system 400 according to still yet another embodiment of the invention. In the instant system, both the first ion funnel and the second ion funnel (FIG. 2*a*) described previously are replaced by two RF multipole ion guides 20*d* and 30*d*, respectively. Multipole ion guides 20*d* and 30*d* can include (2·n) poles to effectively focus and transmit ions, where n is any integer greater than 1. Each pole in multipole ion guide 20*d* can be tilted with a uniform or non uniform angle to create a larger entrance aperture facing the ES plume, and a smaller exit aperture. Other illustrated components (emitter 10 and MS 40) and pressures (e.g. in regions 50, 60, and 70) are identical to those previously described in reference to FIG. 2*a*, but should not be considered limiting. For example, as will be understood by those of skill in the art, multipole ion guides described herein can be further replaced with segmented multipole ion guides. Thus, no limitations should be interpreted by the description to present components. An electric field along the axis of the selected ion guide can be created by applying a DC potential gradient to different segments of the ion guide to rapidly push ions through the ion guide.

In a test configuration of the preferred embodiment of the invention (FIG. 2*a*), emitter 10 was a chemically etched capillary emitter, prepared as described by Kelly et al. (in *Anal. Chem.* 2006, 78, 7796-7801) from 10 μm I.D., 150 μm O.D. fused silica capillary tubing (Polymicro Technologies, Phoenix, Ariz., USA). The ES emitter was coupled to a transfer capillary and a 100 μL syringe (Hamilton, Las Vegas, Nev., USA) by a stainless steel union, which also served as the connection point for the ES voltage. Analyte solutions were infused from a syringe pump (e.g., a model 22 syringe pump, Harvard Apparatus, Inc., Holliston, Mass., USA). Voltages were applied to the ES emitter via a high voltage power supply (e.g., a Bertan model 205B-03R high voltage power supply, Hicksville, N.Y., USA). A CCD camera with a microscope lens (Edmund Optics, Barrington, N.J.) was used to observe the ES. Placement of the ES emitter was controlled by a mechanical vacuum feedthrough (Newport Corp., Irvine, Calif., USA). A stainless steel chamber was constructed to accommodate placement of the ES emitter at the entrance of the first ion funnel. The chamber used three glass windows, one at the top of the chamber, and one on each side of the chamber that allowed proper lighting for visual observation of the ES by the CCD camera. An ion funnel consisting of seventy (70) electrodes was used to allow the ES emitter to be observed through the viewing windows. A grid electrode (FIG. 2*a*) was made from a ~8 line-per-cm mesh rated at 93.1% transmission and placed 0.5 mm in front of the first ion funnel as a counter electrode for the ES, biased to 450 V. The ES emitter was placed 5 mm in front of the grid electrode and centered on axis with the ion funnel. The vacuum chamber contained feedthroughs for the ES voltage, an infusion capillary, and a gas line controlled by a leak valve to room air. A rough pump (e.g., a model E1M18 pump, BOC Edwards, Wilmington, Mass., USA) was used to pump the chamber. The pumping speed was regulated by an in-line valve. A gate valve was built into the first ion funnel and was located between the last ion funnel RF/DC electrode plate and the conductance limiting orifice plate, allowing ES chamber venting and ES emitter maintenance without having to vent the entire mass spectrometer. The gate valve was constructed from a small strip of 0.5 mm thick TEFLON®, which was placed between the last ion funnel electrode and the conductance limiting orifice electrode and attached to an in-house built mechanical feedthrough, which moved the TEFLON® over the conductance limiting orifice during venting of the ES chamber. For all atmospheric pressure ESI experiments, a conventional configuration (FIG. 1) was used for comparison purposes, comprising a 6.4 cm long, 420 μm I.D. inlet capillary heated to 120° C. that terminated flush with the first electrode of the first ion funnel. The atmospheric pressure ESI source and ES emitter were controlled using a standard X-Y stage (e.g., a Model 433 translation stage, Newport Corp., Irvine, Calif., USA).

Figure 1:
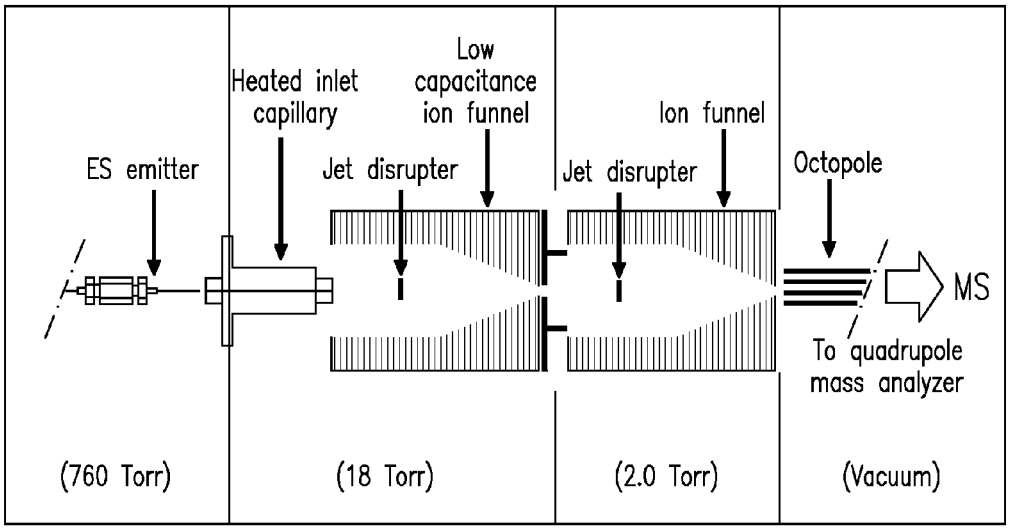
Fig. 1 (Prior Art)
FIG. 1 (Prior Art) illustrates an ESI/MS instrument configuration of a conventional design.

In the test configurations of FIG. 1 and FIG. 2*a*, a low capacitance ion funnel, e.g., as described by Y. Ibrahim et al. (in *J. Am. Soc. Mass Spectrom.* 2006, 17, 1299-1305, incorporated herein in its entirety) was used that could be effectively operated at higher pressure. In the test configuration of FIG. 1, to maintain high ion transmission efficiency at high pressure, both the funnel RF frequency and amplitude were raised from typical operating frequencies and amplitudes of 550 kHz and 80 $V_{p-p}$ to 1.3 MHz and 175 $V_{p-p}$, respectively. The first ion funnel consisted of 100, 0.5 mm thick ring electrode plates separated by 0.5 mm thick TEFLON® insulators. A front straight section of the ion funnel consisted of 58 electrodes with a 25.4 mm I.D. The tapered section of the ion funnel included 42 electrodes that linearly decreased in I.D., beginning at 25.4 mm and ending at 2.5 mm. A jet disrupter electrode described, e.g., by J. S. Page et al. (in *J. Am. Soc. Mass Spectrom.* 2005, 16, 244-253) was placed 2 cm down from the first ion funnel plate and biased to 380 V. The last electrode plate was a DC-only conductance limiting orifice with a 1.5 mm I.D. biased to 210 V. Excess metal was removed from the electrode plates to reduce capacitance, enabling greater RF frequencies and voltages. In the test configuration of FIG. 2*a*, the first ion funnel was otherwise identical to that in test configuration FIG. 1 except that 30 funnel electrodes were removed from the straight section, leaving a total of 28 electrodes with a 25.4 mm I.D. in the straight section of the ion funnel. A 1.3 MHz RF with an amplitude of 350 $V_{P-P}$ was used. No jet disrupter was used for the first ion funnel in the test configuration of FIG. 2*a*. The first ion funnels in both test configurations of FIG. 1 and FIG. 2*a* had the same DC voltage gradient of 18.5 V/cm. The second ion funnel was identical to the first ion funnel in FIG. 1 and used in a subsequent vacuum region for both the test configurations of FIG. 1 and FIG. 2*a*. A 740 kHz RF with amplitude of 70 $V_{P-P}$ was applied to the second ion funnel along with a DC voltage gradient of 18.5 V/cm. The jet disrupter and 2.0 mm I.D. conductance limiting orifice were biased to 170 V and 5 V, respectively. An Agilent MSD 1100 (Santa Clara, Calif.) single quadrupole mass spectrometer was coupled to the dual ion funnel interface, and ultimately to the ESI ion source and emitter. Mass spectra were acquired with a 0.1 m/z step size. Each spectrum was produced from an average of 10 scans to reduce effects of any intensity fluctuations in the ES.

In the test configuration, a linear array of (23) electrodes was incorporated into the front section of a heated capillary assembly, described, e.g., by J. S. Page et al. (in *J. Am. Soc. Mass Spectrom.* 2007, in press) to profile the ES current lost on the front surface of the entrance aperture at various ES chamber pressures. A 490 μm id, 6.4 cm long, stainless steel capillary was silver soldered in the center of a stainless steel body. Metal immediately below the entrance aperture was removed and a small stainless steel vice was constructed on the entrance aperture to press 23 KAPTON®-coated 340 μm O.D. copper wires in a line directly below the aperture entrance. The front of the entrance aperture was machined flat and polished with 2000 grit sandpaper (Norton Abrasives, Worcester, Mass.) making the ends of the wires an array of round, electrically isolated electrodes each with diameter of 340 μm. The other ends of the wires were connected to an electrical breadboard with one connection to common ground and another to a picoammeter (e.g., a Keithley model 6485 picoammeter, Keithley, Cleveland, Ohio) referenced to ground. The electrode array was used as the inlet to the single quadrupole mass spectrometer and installed inside the ES vacuum chamber. ES current was profiled by sequentially detecting current on all 23 electrodes by selecting and manually moving the appropriate wire from the common ground output to the picoammeter input and acquiring 100 consecutive measurements. Measurements were averaged using the data acquisition capabilities of the picoammeter. A further understanding of the preferred embodiment of the ES source and emitter of the invention will follow from Examples presented hereafter.

Example 1

Testing of Low Pressure ESI Source and Emitter

Figure 3A:
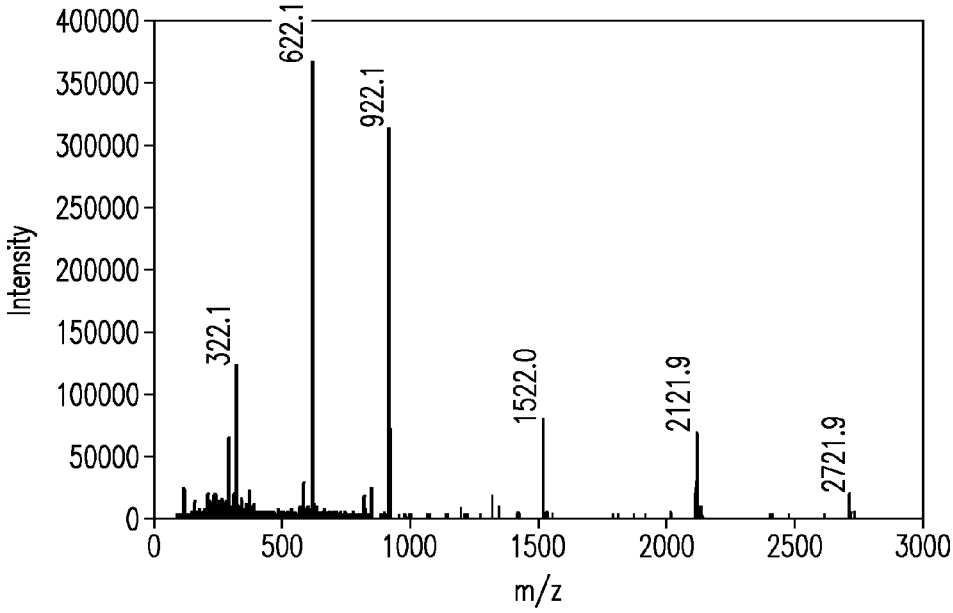
FIGS. 3*a*-3*b* present mass spectra resulting from a calibration solution infused (a) through a conventional atmospheric pressure ESI emitter and heated inlet capillary interface, and (b) through a low pressure ESI emitter of the invention.
Figure 3B:
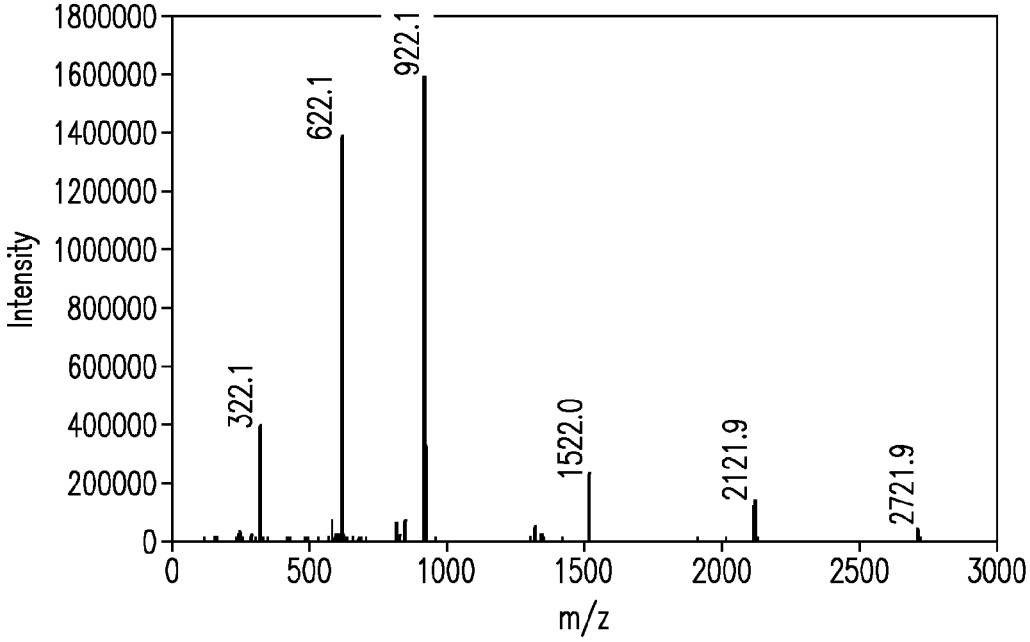
Figure 4A:
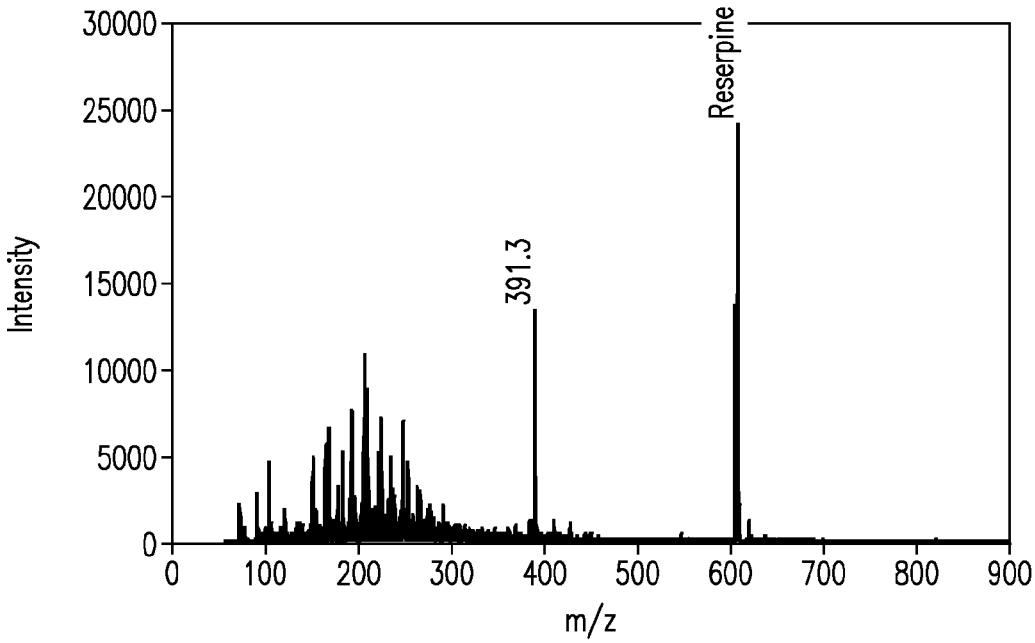
FIGS. 4*a*-4*c* present mass spectra resulting from a reserpine solution (a) infused through a conventional atmospheric pressure ESI emitter and heated inlet capillary interface, (b) infused through a low pressure ESI emitter of the invention, and (c) analyzed with RF voltage to a first ion funnel turned off.
Figure 4B:
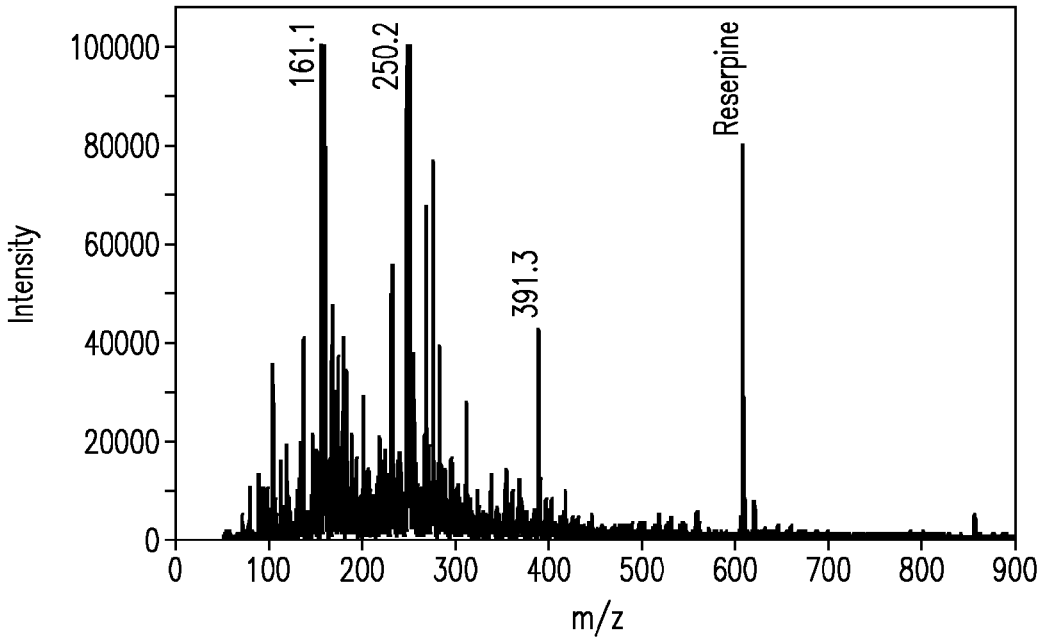
Figure 4C:
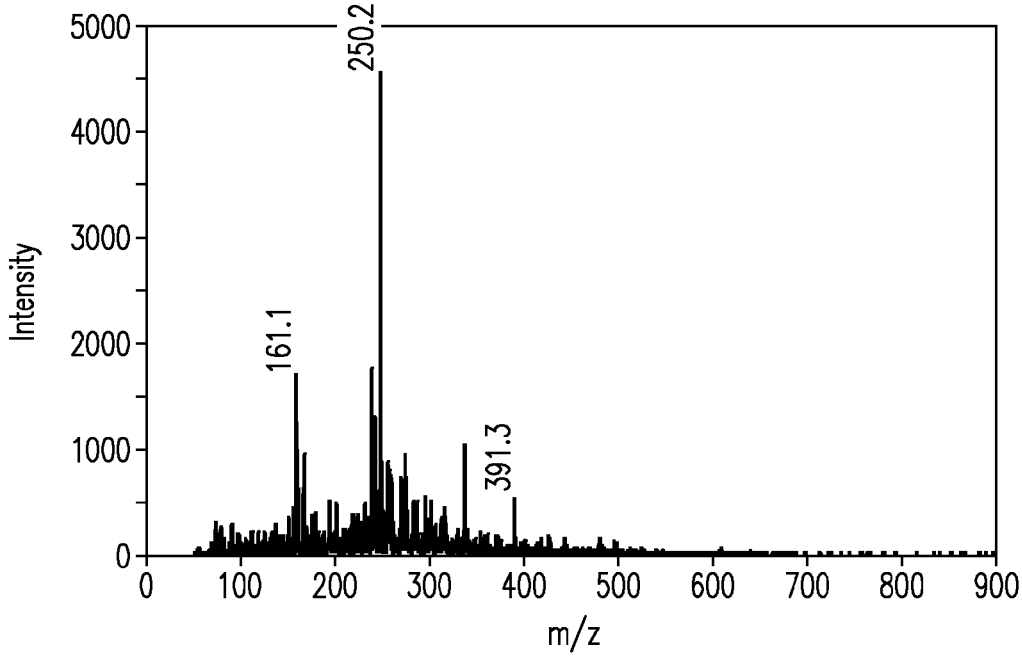

The low pressure ESI source and emitter of the preferred embodiment of the invention was tested by analyzing 1) a calibration (calibrant) solution (Product No. G2421A, Agilent Technologies, Santa Clara, Calif., USA) containing a mixture of betaine and substituted triazatriphosphorines dissolved in acetonitrile and 2) a reserpine solution (Sigma-Aldrich, St. Louis, Mo., USA). A methanol:water solvent mixture for ESI was prepared by combining purified water (Barnstead Nanopure Infinity system, Dubuque, Iowa) with methanol (HPLC grade, Fisher Scientific, Fair Lawn, N.J., USA) in a 1:1 ratio and adding acetic acid (Sigma-Aldrich, St. Louis, Mo., USA) at 1% v/v. A reserpine stock solution was also prepared in a n-propanol:water solution by combining n-propanol (Fisher Scientific, Hampton, N.H., USA) and purified water in a 1:1 ratio and then diluting the ES solvent to a final concentration of 1 μM. Respective solutions were then electrosprayed: A) using conventional atmospheric pressure ESI with the heated inlet capillary (see FIG. 1) and B) using the low pressure ESI source in which the ES emitter was placed at the entrance aperture of the first ion funnel (FIG. 2*a*) in the first low vacuum pressure region at 25 Torr. FIGS. 3*a*-3*b* present mass spectra obtained with respective instrument configurations from analyses of the calibration solution infused at 300 nL/min. FIGS. 4*a*-4*c* present mass spectra obtained with respective instrument configurations from analyses of a 1 μM reserpine solution infused at 300 nL/min. In FIG. 4*c*, the spectrum was acquired with RF voltage to the first ion funnel turned off, which greatly reduced ion transmission and showed utility of the ion guide in the preferred embodiment of the invention.

A comparison of results from analysis of the calibration solution using the test configuration with the low pressure ESI source of the preferred embodiment of the invention (FIG. 2*a*) and the conventional atmospheric ESI (FIG. 1) in FIGS. 3*a* and 3*b* showed a 4- to 5-fold improvement in sensitivity when ES was performed using the low pressure ESI source. In FIG. 4*b*, a sensitivity increase of ~3 fold for reserpine is obtained over that obtained in FIG. 4*a*. In the preferred configuration, the emitter was positioned so that the ion/charged droplet plume was electrosprayed directly into the first ion funnel. Both the emitter and ion funnel were in a 25 Torr pressure environment. Results indicate that removing the conventional capillary inlet and electrospraying directly into an ion funnel can decrease analyte loss in an ESI interface. In FIG. 4*c*, turning off the RF voltage of the first ion funnel eliminates ion focusing in this (ion funnel) stage, greatly reducing focusing and thus transmission of ions to subsequent stages and to the mass spectrometer. Results demonstrate need for the ion funnel, which effectively transmits ES current into the second ion funnel.

In these spectra, in addition to reserpine peaks, there is also an increase in lower mass background peaks which correspond to singly charged ion species, but do not correspond to typical reserpine fragments. Origin of these peaks is unclear, but may be evidence of clusters of solvent species or impurities.

In these figures, reduction in analyte losses using the low pressure ESI source of the preferred embodiment of the invention yields corresponding increases in ion sensitivity, a consequence of removing the requirement for ion transmission through a metal capillary.

Example 2

ES Current Profiling

Figure 5:
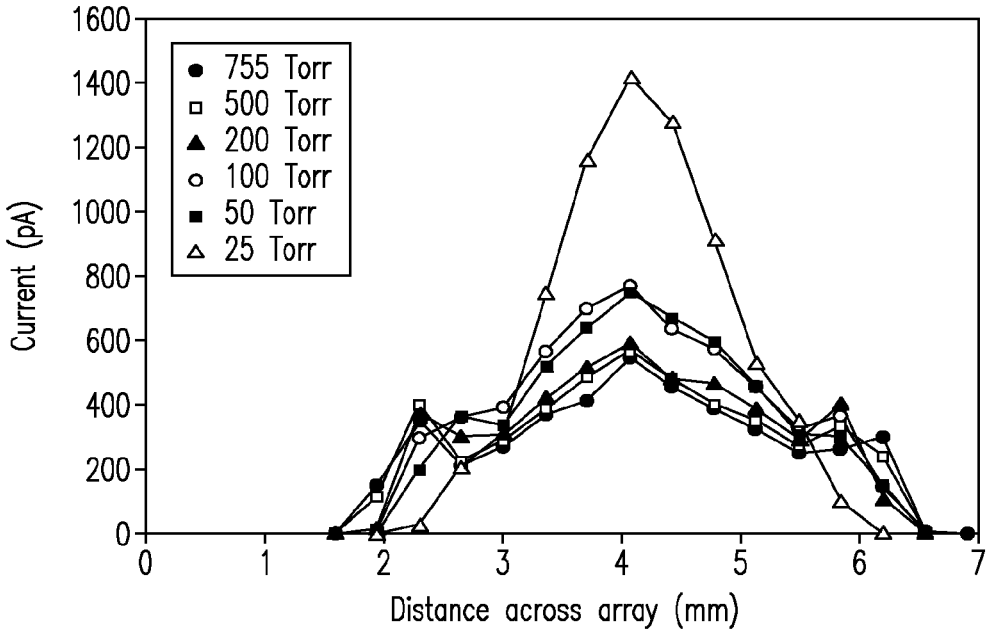
FIG. 5 plots ES current across an ion plume as a function of different ES chamber pressures.

The ES current was profiled at various chamber pressures using a linear array of charge collectors positioned on the mass spectrometer inlet. Pressures ranged from atmospheric pressure (e.g., 760 Torr) to 25 Torr. Current was measured using a special counter electrode array positioned 3 mm from the ESI emitter, which provided a profile, or slice, of the ES current at the center of the ion/charged droplet plume. The solvent mixture electrosprayed by the ESI emitter consisted of a 50:50 methanol:water solution with 1% v/v acetic acid, which was infused to the ES emitter at a flow rate of 300 nL/min. Utility of an electrode array in the characterization of electroprays is described, e.g., by J. S. Page et al. (in *J. Am. Soc. Mass Spectrom.* 2007, in press). FIG. 5 plots the radial electric current distribution of the electrospray plume as a function of pressure.

In the figure, a stable ESI current of 42 nA was achieved at the selected (300 nL/min) flow rate, which can be maintained in a broad range of pressures by simply adjusting the spray voltage. As shown in FIG. 5, a well behaved electrospray is evident for pressures as low as 25 Torr. Higher pressures produced a plume that was ~5 mm wide. At 100 Torr and 50 Torr, the plume narrowed slightly with an increase ES current density and this was more pronounced at 25 Torr. ES flow rate, voltage, and current changed minimally as pressure was lowered. Decrease in the spray plume angle at lower pressures may be a consequence of narrower ion/droplet plumes detected by the electrode array. Results are attributed to an increase in electrical mobility as a result of an increase in mean-free-path, described, e.g., by Gamero-Castano et al. (in *J. Appl. Phys.* 1998, 83, 2428-2434). Another observation was the independence of the electrospray (ES) on pressure, which has been described, e.g., Aguirre-de-Carcer et al. (in *J. Colloid Interface Sci.* 1995, 171, 512-517). Profiling of the ES current detected the charge distribution across the ion/charged droplet plume, but did not provide information on the creation (ionization) of liberated, gas-phase, ions, i.e., the "ionization efficiency". Ionization efficiency is described further hereafter.

Example 3

Ionization Efficiency

In order to investigate ionization efficiency, the low pressure ES source was coupled to a single quadrupole mass spectrometer. Baseline measurements of a reserpine and calibration solution prepared as in Example 1 were first acquired using a standard atmospheric ESI source with a heated metal inlet capillary (FIG. 1). The test configuration used two ion funnels. The front ion funnel operated at 18 Torr; back ion funnel operated at 2 Torr. Similar transmission efficiencies were obtained to those described, e.g., Ibrahim, et al. (in *J. Am. Soc. Mass Spectr.* 2006, 17, 1299-1305) for single ion funnel interfaces, while allowing a much larger sampling efficiency (i.e., inlet conductance).

Example 4

Effect of Varying RF Voltage on Analyte Declustering/Desolvation

Figure 6:
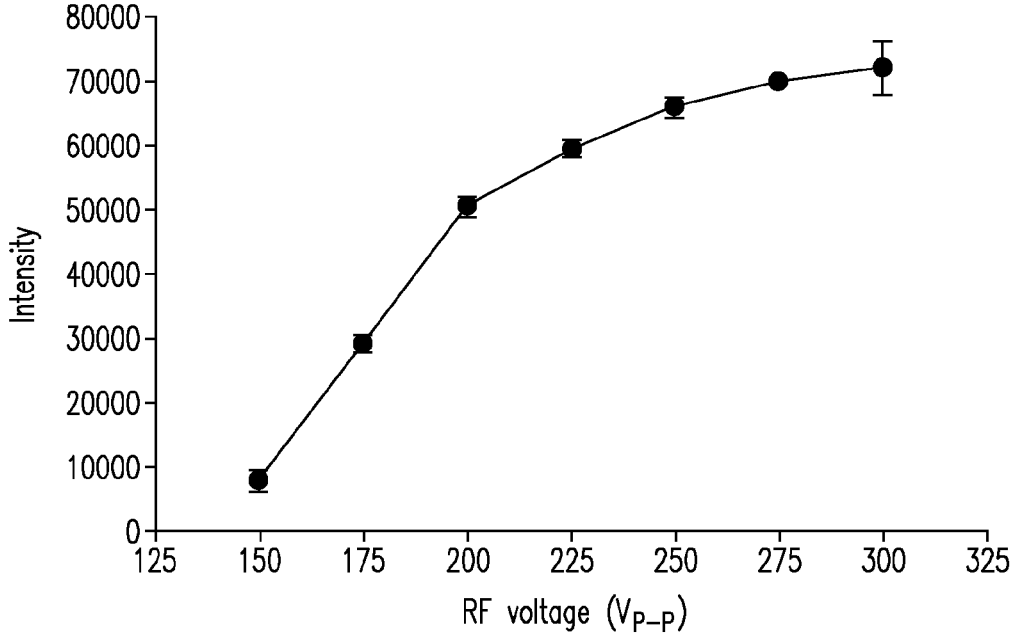
FIG. 6 plots peak intensity as a function of RF voltage for a reserpine solution analyzed with the preferred embodiment of the invention.

Importance of declustering/desolvation and transmission in the low pressure ESI source configuration of the invention was further investigated by varying RF voltage. Ion funnels have been shown to impart energy to analyte ions by RF heating, described, e.g., by Moision et al. (in *J. Am. Soc. Mass Spectrom.* 2007, 18, 1124-1134). The greater the RF voltage, the greater the amount of energy conveyed to ions/clusters, which can aid desolvation and declustering. FIG. 6 is a plot of reserpine intensity versus the amplitude of RF voltage applied to the first ion funnel. In the figure, error bars indicate the variance in three replicate measurements. Peak intensity quickly rises as the voltage is increased and begins to level off around 300 $V_{P-P}$, indicating that adding energy to the ions/clusters liberates more reserpine ions. Increasing voltage also increases the effective potential of the ion funnel, which may provide better focusing of droplets and larger clusters contributing to increased sensitivity.

As will be appreciated by those of skill in the art, components in the instrument configurations described herein are not limited. For example, as described hereinabove, the first ion funnel can be used as a desolvation stage for removing solvent from analytes of interest. Desolvation may be further promoted, e.g., in conjunction with heating of the emitter and/or other instrument components using a coupled heat source, including, but not limited to, e.g., heated gases and sources, radiation heat sources, RF heat sources, microwave heat sources, radiation heat sources, inductive heat sources, heat tape, and the like, and combinations thereof. Additional components may likewise be used as will be selected by those of skill in the art. Thus, no limitations are intended.

Example 5

Effect of Fixed RF Voltage and Varying Flow Rates on Analyte Desolvation

Figure 7:
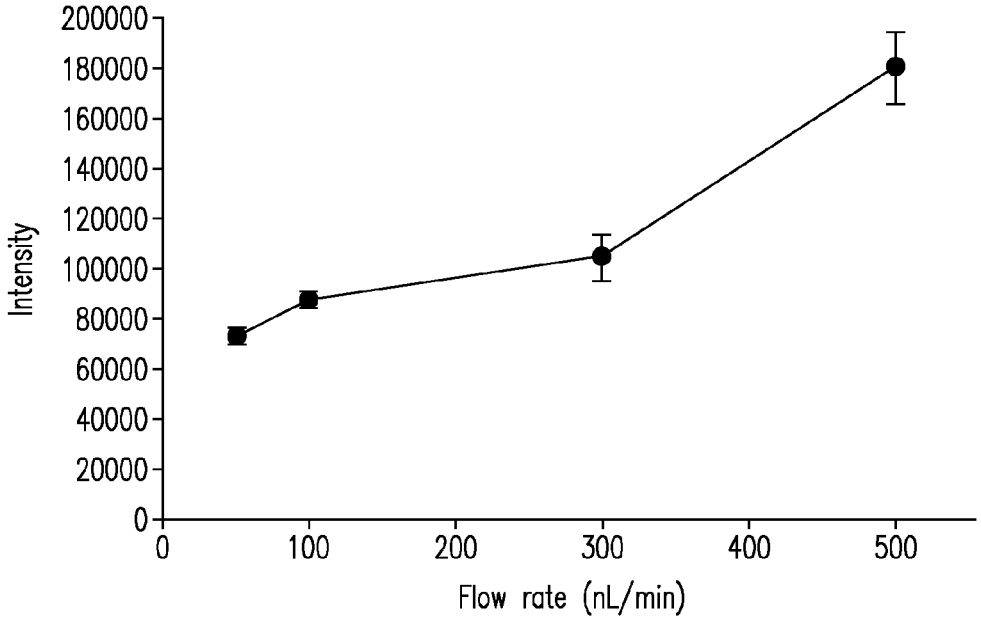
FIG. 7 plots peak intensity as a function of flow rate at fixed RF voltage for a reserpine solution, analyzed with the preferred embodiment of the invention.

Analyte desolvation was further explored by changing solution flow rates and keeping RF voltage fixed at 350 $V_{P-P}$. To determine if smaller droplets improve desolvation in the low pressure ESI source of the invention, reserpine solution was infused at flow rates ranging from 50 nL/min to 500 nL/min. FIG. 7 plots peak intensity for reserpine, with error bars corresponding to three replicate measurements. In the figure, peak intensity decreases initially as flow rate is lowered from 500 nL/min to 300 nL/min, and begins to decrease more slowly at the lower flow rates. Results indicate that even though less reserpine is delivered to the ES emitter at lower flow rates, a greater percentage of reserpine is converted to liberated ions. Results demonstrate 1) that the ion funnel effectively desolvates smaller droplets, and 2) that improved desolvation is needed at higher flow rates.

ES droplet size correlates with the flow rate, as described, e.g., by Wilm et al. (in *Int. J. Mass Spectrom. Ion Processes* 1994, 136, 167-180) and Fernandez de la Mora et al. (in *J. Fluid Mech.* 1994, 155-184). Smaller flow rates thus create smaller droplets, and smaller droplets require less desolvation and fission events to produce liberated analyte ions.

Example 6

Ion Transmission Efficiency

Figure 8:
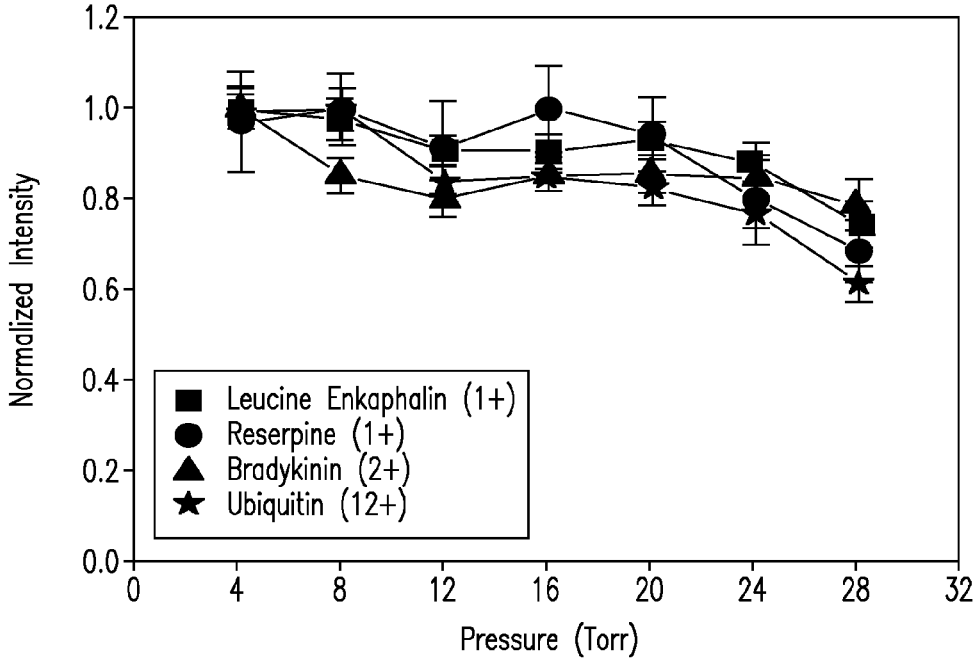
FIG. 8 plots transmission curves for leucine, enkephalin, reserpine, bradykinin and ubiquitin ions as a function of pressure, analyzed with the preferred embodiment of the invention.

Transmission efficiency of ions in an ion funnel was tested as a function of pressure by analyzing ions having different mass-to-charge ratios. Ions included Leucine, Enkephalin, Reserpine, Bradykinin, and Ubiquitin. The first ion funnel was operated with RF 1.74 MHz and amplitude ranging from 40 to 170 $V_{p-p}$. The second ion funnel was operated at RF 560 kHz and 70 $V_{p-p}$. FIG. 8 presents experimental results.

In the figure, data for Bradykinin represent the sum of 2+ charge states. Data for Ubiquitin represent the sum of charge states up to 12+. Each dataset is normalized to its own high intensity point. Ion transmission efficiency remains approximately constant up to a 30 Torr pressure maximum. Overlapping operating pressure between the low pressure electrospray and the high pressure ion funnel makes it possible to couple them directly without the need of an inlet orifice/capillary. Results demonstrate that stable electrospray can be maintained at pressures as low as 25 Torr and that good ion transmission can be obtained in the high pressure ion funnel at pressures as high as 30 Torr. Overlap between the two pressures indicates that the concept of interfaceless ion transmission in the instrument is practical. Results further indicate that biological analyses in conjunction with the invention are conceivable and may ultimately prove to be an enabling technology applicable to high-throughput proteomics analyses. The invention could thus prove to be a significant breakthrough in reducing ion losses from electrospray ionization, which along with MALDI, is a prevalent form of ionizing biological samples for analysis by mass spectrometry.

Results presented herein are an initial demonstration of an ESI source/ion funnel combination for producing and transmitting ions in a low pressure (e.g., 25 Torr) environment for use in MS instruments. Use of the ion funnel or other alternatives as illustrated in FIG. 2 is critical to the success of the low pressure ESI source. A large (~2.5 cm), entrance I.D. provides sufficient acceptance area for an entire ES plume to be sampled into the ion funnel device. In addition, the length of the ion funnel and the RF field employed therein provide a region for desolvation prior to transmission into the mass spectrometer. Sensitivity gains were observed for all solutions analyzed.

In the detailed description of the embodiments and examples above, the electrospray transmitter is positioned in a direct relationship with a receiving aperture of a first ion guide. Furthermore, the electrospray transmitter and the first ion guide are positioned together in a single vacuum region. However, in a more preferred embodiment, the ESI transmitter and the first ion guide are operated at different pressures.

Figure 9:
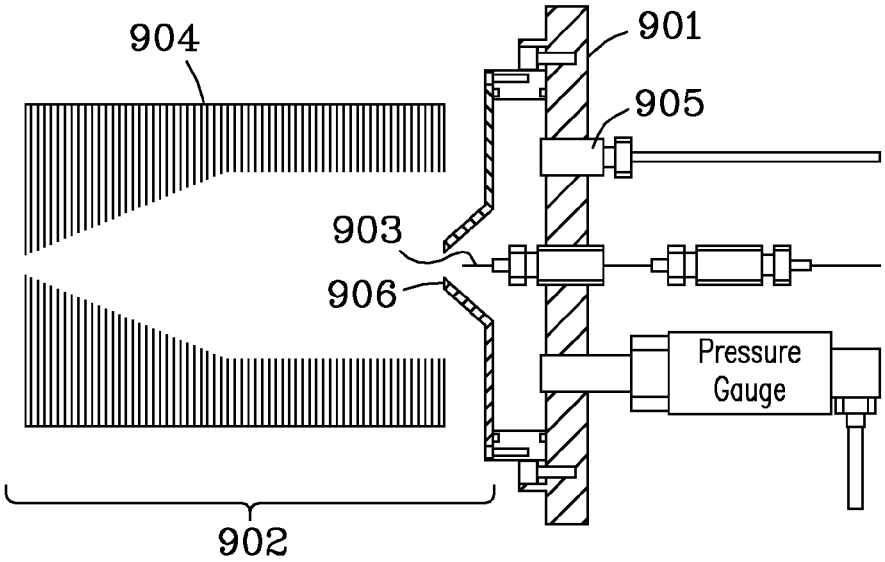
FIG. 9 is an illustration depicting an ESI source according to one embodiment of the present invention.

Referring to FIG. 9, the illustration depicts one such embodiment. Specifically, a first vacuum chamber 901 encloses both an ESI emitter 903 and a feedline 905 for a supply gas. The first vacuum chamber has an exit orifice 906 through which electrospray ions can be transmitted to the entrance of an ion funnel 904 that is positioned in a second vacuum chamber 902. A pump can maintain a base vacuum in both the first and second vacuum chambers while a pressure differential can be established between the two chambers based on the amount of supply gas admitted into the first vacuum chamber and on the size of the exit orifice, which has a limited conductance. This allows for a higher pressure in the first chamber, which is more optimal for the ESI emitter, and a lower pressure in the second chamber, which is more optimal for the ion funnel. Furthermore, as is described in various other embodiments, the positioning of the ESI transmitter with respect to the exit orifice at the entrance of the ion funnel maximizes ion transmission from the ESI emitter into the ion funnel, thereby avoiding the problems that are common among configurations taught in the prior art (e.g., see FIG. 1).

Example 7

Figure 10:
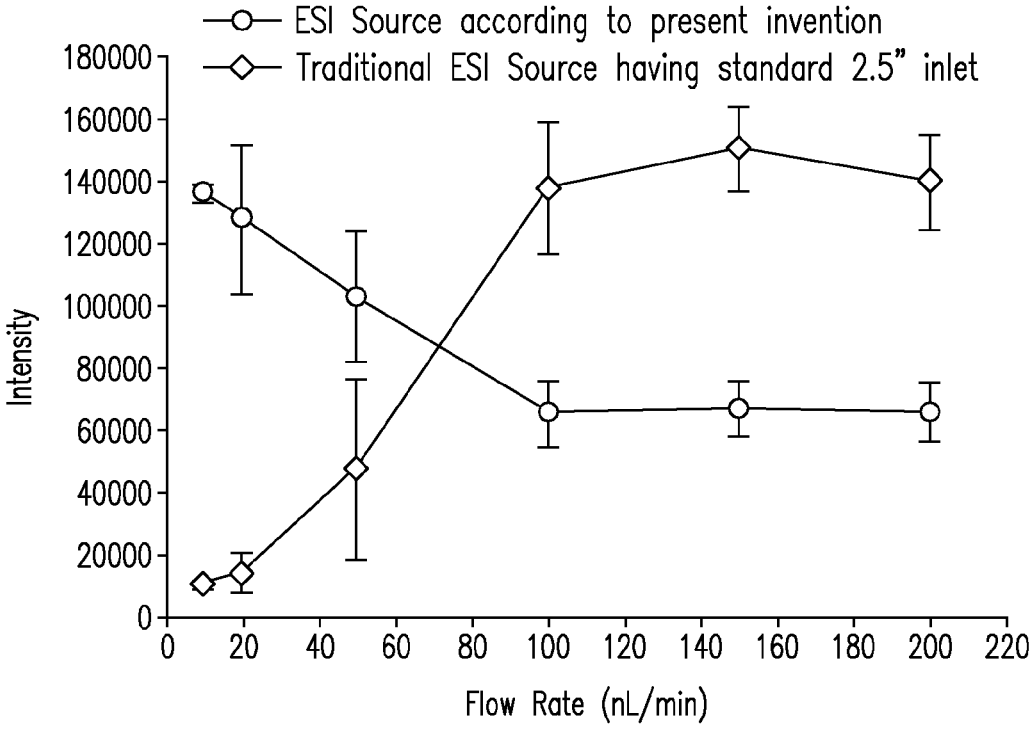
FIG. 10 is a plot of peak intensities at different electrospray flow rates for peptide ions using the embodiment depicted in the FIG. 9 compared to a conventional ESI-MS ion source design.
Figure 11A:
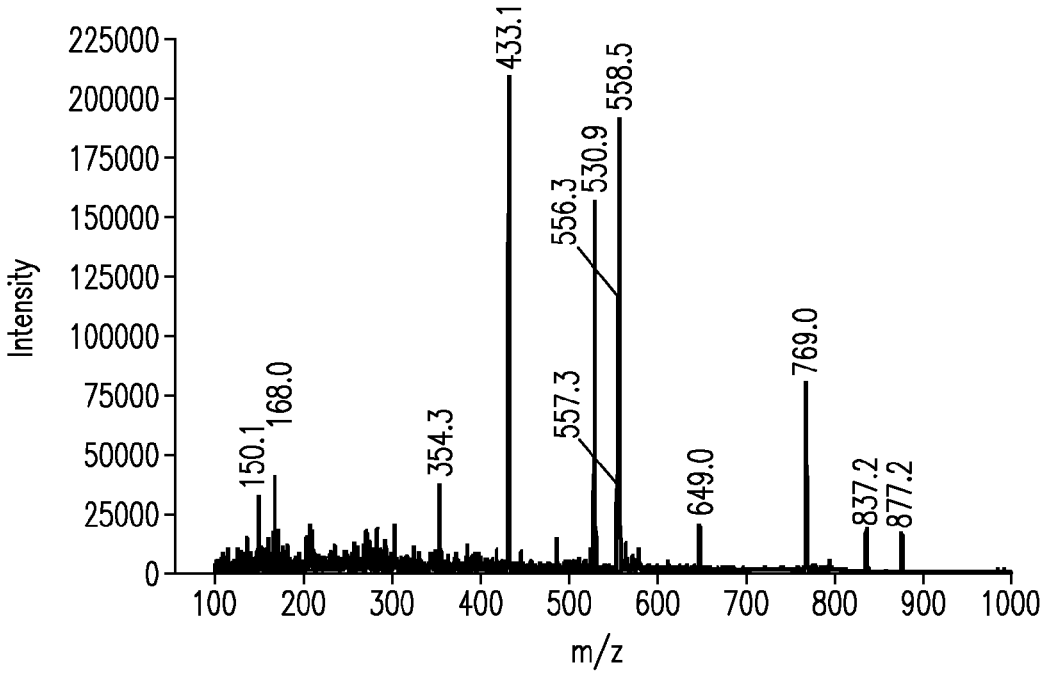
FIGS. 11*a* and 11*b* compare the mass spectra obtained using the embodiment depicted in the FIG. 9 and a conventional ESI-MS ion source design.
Figure 11B:
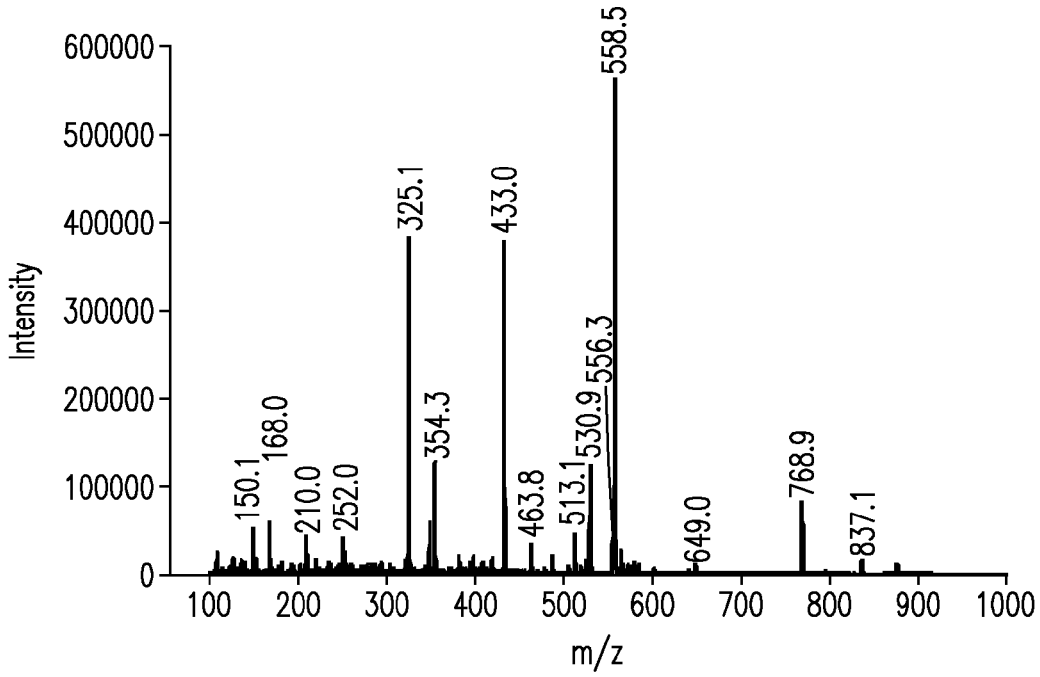

Experimental data obtained using the embodiment illustrated in FIG. 9 and described elsewhere herein are shown in FIGS. 10 and 11. The pressure of the first vacuum chamber containing the ESI emitter was 50 Torr. The pressure of the second vacuum chamber containing the first ion guide was 25 Torr. FIG. 10 plots the MS signal from a peptide analysis versus flow rate. The signal from the peptide improves with lower flow rates when the embodiment in FIG. 9 is used compared with a conventional ESI source. An additional benefit of the FIG. 9 embodiment is shown in FIG. 11, where mass spectra from the analysis of a five peptide solution are displayed using a conventional ESI source (11*a*) and the FIG. 9 embodiment (11*b*). In both cases the solution was electrosprayed at a 10 nL/min flow rate. The use of the FIG. 9 embodiment shows increased sensitivity (especially for higher charge state peptides) and a reduction of lower m/z chemical background, improving the signal-to-noise ratio.

While an exemplary embodiment of the present invention has been shown and described, it will be apparent to those skilled in the art that many changes and modifications may be made without departing from the invention in its true scope and broader aspects. The appended claims are therefore intended to cover all such changes and modifications as fall within the spirit and scope of the invention.

We claim:

1. An electrospray ionization (ESI) source characterized by a first vacuum chamber enclosing both an ESI transmitter and a feed line for a supply gas, the first vacuum chamber having a pressure between 1 and 200 Torr and having an exit orifice in a wall of the first vacuum chamber and not a capillary tube, the exit orifice having a diameter between 2 and 5 mm positioned at an entrance to a first ion guide enclosed in a second vacuum chamber having a pressure between 1 and 100 Torr, wherein a sample comprising electrospray ions is transmitted from the ESI transmitter to the ion guide through the exit orifice.

2. The ESI source of claim 1, wherein the ESI transmitter comprises a plurality of emitters.

3. The ESI source of claim 1, wherein the ion guide is an electrodynamic ion funnel.

4. The ESI source of claim 1, wherein the ion guide is a multi-pole ion guide having a receiving aperture and a relatively smaller exit aperture.

5. The ESI source of claim 4, wherein the ion guide comprises 2n poles, where n is an integer greater than or equal to 2.

6. The ESI source of claim 4, wherein the multi-pole ion guide is a segmented multi-pole ion guide.

7. The ESI source of claim 1, wherein the pressure in the first vacuum chamber is at least two times greater than that of the second vacuum chamber.

8. The ESI source of claim 1, further comprising a pump maintaining a vacuum in the first and the second vacuum chambers, wherein a pressure differential is established between the first and the second vacuum chambers at least in part by the supply gas and the exit orifice, which has a limited conductance.

9. The ESI source of claim 1, wherein at least 50% of the electrospray current is transmitted from the ESI transmitter to the ion guide.

10. The ESI source of claim 1, further comprising a chamber heating element providing control of the temperature in the first vacuum chamber.

11. The ESI source of claim 1, wherein the supply gas comprises an electron scavenger that reduces the electrical breakdown in the first vacuum chamber.

12. The ESI source of claim 11, wherein the supply gas is $CO_2$, $SF_6$ or a mixture of both.

13. The ESI source of claim 1, further comprising a controller regulating the supply gas flow.

14. The ESI source of claim 1, further comprising a second ion guide positioned downstream of the first ion guide.

15. The ESI source of claim 14, wherein the second ion guide is positioned in a third vacuum region having a pressure less than that of the second vacuum region.

16. An electrospray ionization (ESI) source characterized by a first vacuum chamber enclosing both an ESI transmitter and a feed line for a supply gas, the first vacuum chamber having a pressure between 1 Torr and 200 Torr and an exit orifice in a wall of the first vacuum chamber, the exit orifice positioned at an entrance to a first ion guide enclosed in a second vacuum chamber, which has a pressure between 1 Torr and 100 Torr, wherein a sample comprising electrospray ions is transmitted from the ESI transmitter to the ion guide through the exit orifice and at least 50% of an electrospray current at the ESI transmitter is transmitted to the ion guide.

* * * * *

UNITED STATES PATENT AND TRADEMARK OFFICE

CERTIFICATE OF CORRECTION

PATENT NO. : 8,173,960 B2
APPLICATION NO. : 12/468645
DATED : May 8, 2012
INVENTOR(S) : Keqi Tang et al.

It is certified that error appears in the above-identified patent and that said Letters Patent is hereby corrected as shown below:

Col. 1, Lines 8-11 should be replaced with the following:

The invention was made with Government support under grant number RR018522 from the U.S. National Institutes of Health and contract DE-AC05-76RL01830 awarded by the US Department of Energy. The government has certain rights in the invention.

Signed and Sealed this
Twenty-sixth Day of June, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,173,960 B2
APPLICATION NO. : 12/468645
DATED : May 8, 2012
INVENTOR(S) : Keqi Tang et al.

It is certified that error appears in the above-identified patent and that said Letters Patent is hereby corrected as shown below:

Col. 5, line 32: replace “5 mm” with “~5 mm”

Signed and Sealed this
Seventh Day of August, 2012

David J. Kappos

David J. Kappos
*Director of the United States Patent and Trademark Office*